US011051586B2

(12) United States Patent
Becker

(10) Patent No.: US 11,051,586 B2
(45) Date of Patent: Jul. 6, 2021

(54) INSOLE AND FOOTBED FOR GOLF SHOES THAT IMPROVES BALANCE, POSTURE AND STABILITY TO ENHANCE THE GOLF SWING

(71) Applicant: OrthoGolfer, LLC, Englewood, FL (US)

(72) Inventor: J. Scott Becker, Englewood, FL (US)

(73) Assignee: OrthoGolfer, LLC, Englewood, FL (US)

( * ) Notice: Subject to any disclaimer, the term of this patent is extended or adjusted under 35 U.S.C. 154(b) by 229 days.

(21) Appl. No.: 15/975,337

(22) Filed: May 9, 2018

(65) Prior Publication Data

US 2018/0325214 A1 Nov. 15, 2018

Related U.S. Application Data

(60) Provisional application No. 62/504,982, filed on May 11, 2017.

(51) Int. Cl.

| | |
|---|---|
| ***A43B 17/02*** | (2006.01) |
| ***A43B 5/00*** | (2006.01) |
| ***A43B 7/14*** | (2006.01) |

(52) U.S. Cl.

CPC ..... *A43B 17/02* (2013.01); *A43B 5/001* (2013.01); *A43B 7/143* (2013.01); *A43B 7/144* (2013.01)

(58) Field of Classification Search

None

See application file for complete search history.

(56) References Cited

U.S. PATENT DOCUMENTS

| | | | | | |
|---|---|---|---|---|---|
| 4,557,060 | A | | 12/1985 | Kawashima | |
| 4,682,425 | A | | 7/1987 | Simmons | |
| 4,685,227 | A | | 8/1987 | Simmons | |
| 4,754,561 | A | * | 7/1988 | Dufour | A43B 5/001 36/127 |
| 4,766,679 | A | * | 8/1988 | Bender | A43B 3/0063 36/30 R |
| 4,782,605 | A | * | 11/1988 | Chapnick | A43B 7/142 156/221 |
| 4,953,311 | A | * | 9/1990 | Bruggemeier | A43B 3/0094 36/127 |
| 5,068,983 | A | * | 12/1991 | Marc | A43B 7/142 36/43 |
| 5,146,698 | A | * | 9/1992 | Tilles | A43B 7/144 36/178 |
| 5,212,894 | A | | 5/1993 | Paparo | |
| 5,265,354 | A | * | 11/1993 | Aliano, Jr. | A43B 5/001 36/127 |
| 5,720,118 | A | | 2/1998 | Mayer et al. | |

(Continued)

*Primary Examiner* — Jila M Mohandesi

(74) *Attorney, Agent, or Firm* — McInnes & McLane, LLP

(57) ABSTRACT

Disclosed herein is an insole or footbed for a shoe. The insole includes a forefoot portion having a first thickness at a latitudinal midpoint thereof, a midfoot portion attached to the forefoot portion, and a hindfoot portion attached to the midfoot portion. An energy plug is attached to the midfoot portion and hindfoot portion and covering lateral portions of the dominant foot thereof. The hindfoot portion has a second thickness at a latitudinal midpoint thereof, the second thickness being less than a first thickness. The hindfoot portion includes a support stabilizer at an outside lateral portion of the dominant foot thereof.

17 Claims, 5 Drawing Sheets

(56) References Cited

U.S. PATENT DOCUMENTS

| | | | | |
|---|---|---|---|---|
| 6,286,232 | B1 * | 9/2001 | Snyder | A43B 7/142 36/142 |
| 2004/0118017 | A1 * | 6/2004 | Dalton | A43B 7/142 36/44 |
| 2016/0242497 | A1 * | 8/2016 | Alviso | A43B 7/24 |

* cited by examiner (medial view of right foot insole)

(lateral view of right foot insole)

(medial view of left foot insole)

(lateral view of left foot insole)

INSOLE AND FOOTBED FOR GOLF SHOES THAT IMPROVES BALANCE, POSTURE AND STABILITY TO ENHANCE THE GOLF SWING

PRIOR RELATED APPLICATIONS

This application claims benefit of U.S. Provisional Patent Application Ser. No. 62/504,982 entitled "INSOLE AND FOOTBED FOR GOLF SHOES THAT IMPROVES BALANCE, POSTURE AND STABILITY TO ENHANCE THE GOLF SWING," filed on May 11, 2017.

FEDERALLY SPONSORED RESEARCH STATEMENT

N/A

REFERENCE TO MICROFICHE APPENDIX

N/A

FIELD OF INVENTION

Disclosed herein is an insole or footbed for golf shoes that improves the swing of a golfer by improving posture, reducing lateral foot sway, and improving proprioception.

BACKGROUND OF THE INVENTION

Once a certain level of competency is attained, golf can be a relaxing and enjoyable sport. However, it is necessary for a beginner to learn numerous fundamentals before reaching that level of competency and enjoyment.

It has long been recognized that the ideal golf swing is a somewhat unnatural movement for the skeletal and muscular structure of human beings. Therefore, it is necessary for a golfer to train his muscles to move in the right manner to obtain a proper swing which will cause the ball to be driven along an intended path. A common problem, for example, is the tendency for the golfer's weight to shift to the toe areas during a swing as the weight shifts from the rear foot to the front foot. When a golfer departs from the proper swing, generally due to such improper shifts of weight, a hook, slice, or other undesirable path of the ball will result.

Therefore, there is a need for an aid for a golfer which will assist with maintaining the correct stance during an entire swing.

SUMMARY OF THE INVENTION

This summary is provided to introduce a selection of concepts that are further described below in the detailed description. This summary is not intended to identify key or essential features of the claimed subject matter, nor is it intended to be used as an aid in limiting the scope of the claimed subject matter.

Disclosed herein is an insole for the dominant foot or side of a golfer. The insole includes a forefoot portion having a first thickness at a latitudinal midpoint thereof, a midfoot portion attached to the forefoot portion, and a hindfoot portion attached to the midfoot portion. An energy plug is attached to the midfoot portion and hindfoot portion and covers lateral portions thereof. The hindfoot portion has a second thickness at a latitudinal midpoint thereof, with the second thickness being less than a first thickness. The hindfoot portion includes a support stabilizer at an outside lateral portion thereof.

The support stabilizer may define a third thickness of the hindfoot portion at a lateral portion thereof, and the third thickness is greater than the first thickness. In some cases, the support stabilizer may define a non-uniform thickness of the hindfoot portion that increases toward a lateral most edge of the hindfoot portion.

The midfoot portion may be shaped to define an arch extending between the forefoot portion and the hindfoot portion.

The forefoot portion, midfoot portion, and hindfoot portion may be constructed from resilient material, with the resilient material of the energy plug having a higher rebound rate than that of the resilient material of the forefoot portion, midfoot portion, and hindfoot portion.

The hindfoot portion does not include a lateral support stabilizer at an inside medial portion thereof. The support stabilizer defines a third thickness of the hindfoot portion at an outside lateral portion thereof, the third thickness being greater than the first thickness lacks a medial support stabilizer at the inside medial portion of the hindfoot portion results in a fourth thickness of the hindfoot portion at the inside medial portion thereof being less than the third thickness.

The energy plug may be dimensioned such that when the insole is placed within the shoe and when a foot is placed within the shoe to contact the insole, the energy plug extends from a center of a heel laterally to just distal to the base of the fifth metatarsal of the foot.

Also disclosed is an insole for the non-dominant foot, which is similar to the insole for the dominant foot, but lacks the support stabilizer and power plug.

Also disclosed herein is a method aspect. This method is a method of improving a swing performed by a golfer by making an insole dimensioned to fit within a golf shoe. The method includes improving posture of the golfer during swinging of a golf club by elevating a forefoot of a foot of the golfer positioned within the golf shoe adjacent the insole respect to a hindfoot of the foot using a forefoot portion of the insole formed to have a first thickness at a latitudinal midpoint thereof. The method also includes reducing lateral sway of a foot of the golfer during swinging of the golf club by laterally bracing the foot using a support stabilizer positioned at an outside lateral portion of a hindfoot portion of the insole, with the hindfoot portion of the insole being formed to have a second thickness at a literal midpoint thereof that is greater than the first thickness. The method further includes improving proprioception of the golfer during the swinging of the golf club by shaping a midfoot portion of the sole to define an arch extending between the forefoot portion and the hindfoot portion and fitting snugly against an arch of the foot. In addition, the method may also incorporate returning energy stored during a backswing phase of the swinging of the golf club to a lateral portion of the foot during transition from the backswing phase to a foreswing phase of the swinging of the golf club by attaching an energy plug to cover lateral portions of the midfoot portion and the hindfoot portion of the insole.

These and other objects, features and advantages will become apparent as reference is made to the following detailed description, preferred embodiments, and examples, given for the purpose of disclosure, and taken in conjunction with the accompanying drawings and appended claims.

BRIEF DESCRIPTION OF THE DRAWINGS

For a further understanding of the nature and objects of the present invention, reference should be made to the following detailed disclosure, taken in conjunction with the accompanying drawings, in which like parts are given like reference numerals, and wherein.

DETAILED DESCRIPTION OF EMBODIMENTS OF THE INVENTION

The following detailed description of various embodiments of the present invention references the accompanying drawings, which illustrate specific embodiments in which the invention can be practiced. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains. Therefore, the scope of the present invention is defined only by the appended claims, along with the full scope of equivalents to which such claims are entitled.

Figure 1:
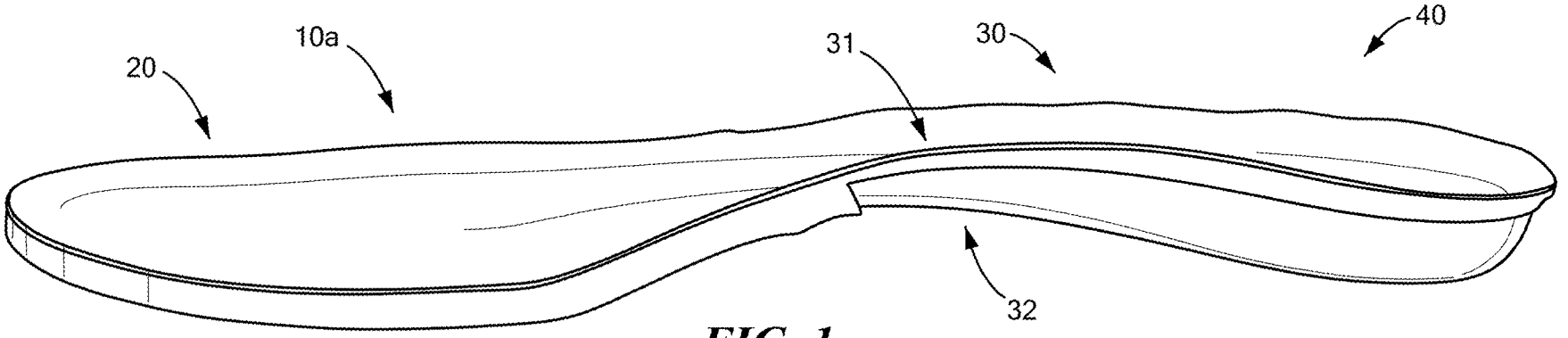
FIG. 1 is a view of an inside (medial) side of an insole for a right shoe for a right handed golfer in accordance with this disclosure.
Figure 2:
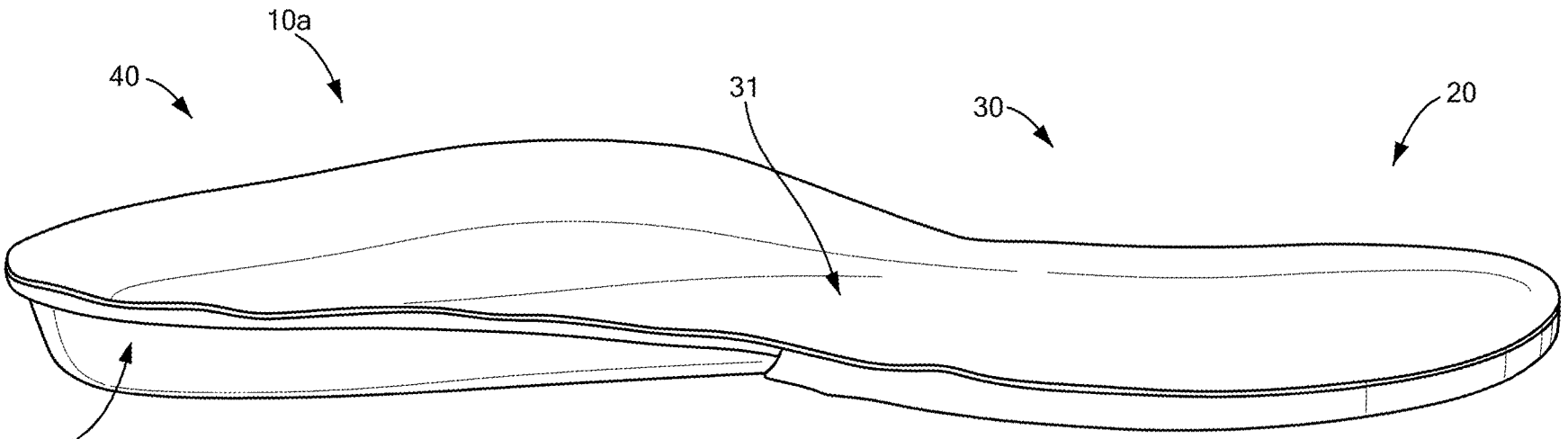
FIG. 2 is a view of an outside (lateral) side of an insole for a right shoe for a right handed golfer in accordance with this disclosure.

With reference to FIGS. 1-2, an insole 10*a* for a golf shoe is now described. This insole 10*a* is for the right shoe of a right handed golfer. The insole 10*a* is comprised of a forefoot portion 20, a midfoot portion 30 attached to the forefoot portion 20, and a hindfoot portion 40 attached to the midfoot portion 30.

Figure 3:
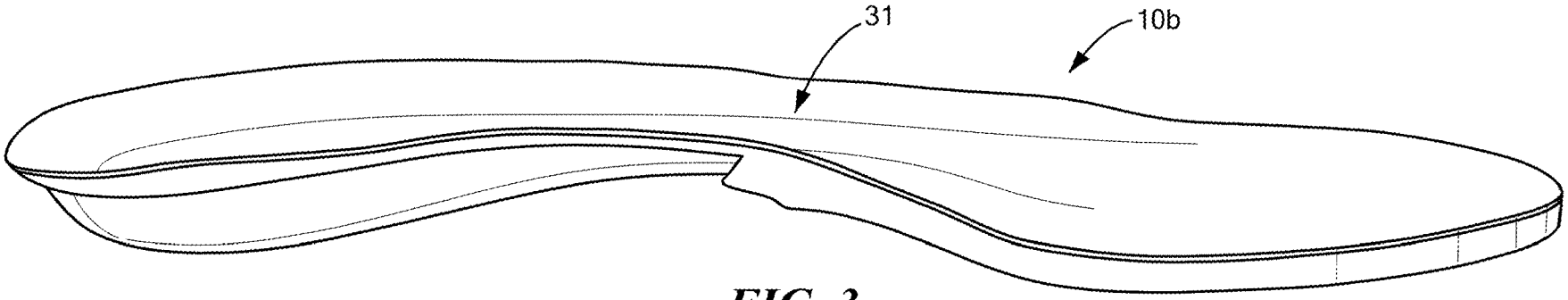
FIG. 3 is a view of an inside (medial) side of an insole for a left shoe for a right handed golfer in accordance with this disclosure.
Figure 4:
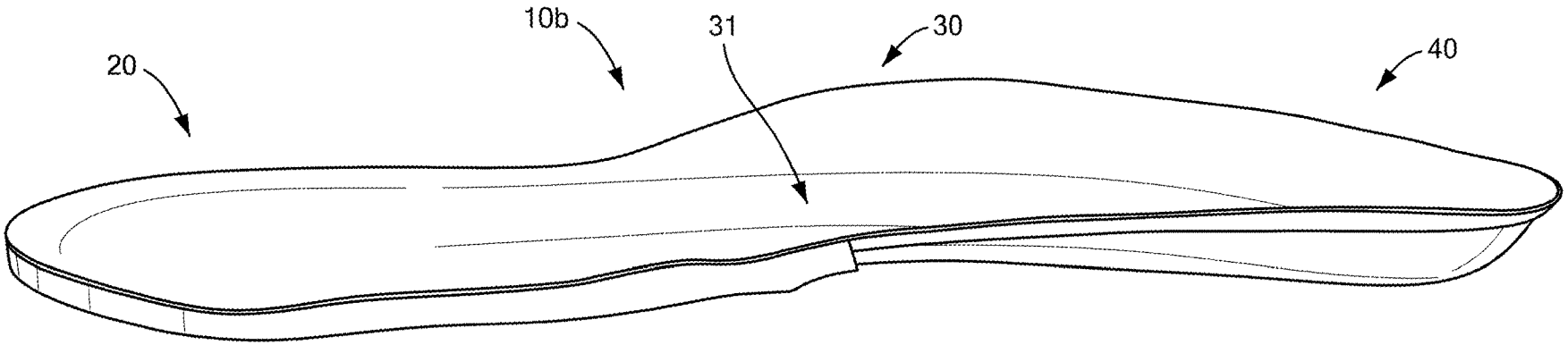
FIG. 4 is a view of an outside (lateral) side of an insole for a left shoe for a right handed golfer in accordance with this disclosure.

Also described with additional reference to FIG. 3-4 is an insole 10*b* for the left shoe of a right handed golfer. The insole 10*b* is likewise comprised of a forefoot portion 20, a midfoot portion 30 attached to the forefoot portion 20, and a hindfoot portion 40 attached to the midfoot portion 30.

Figure 6:
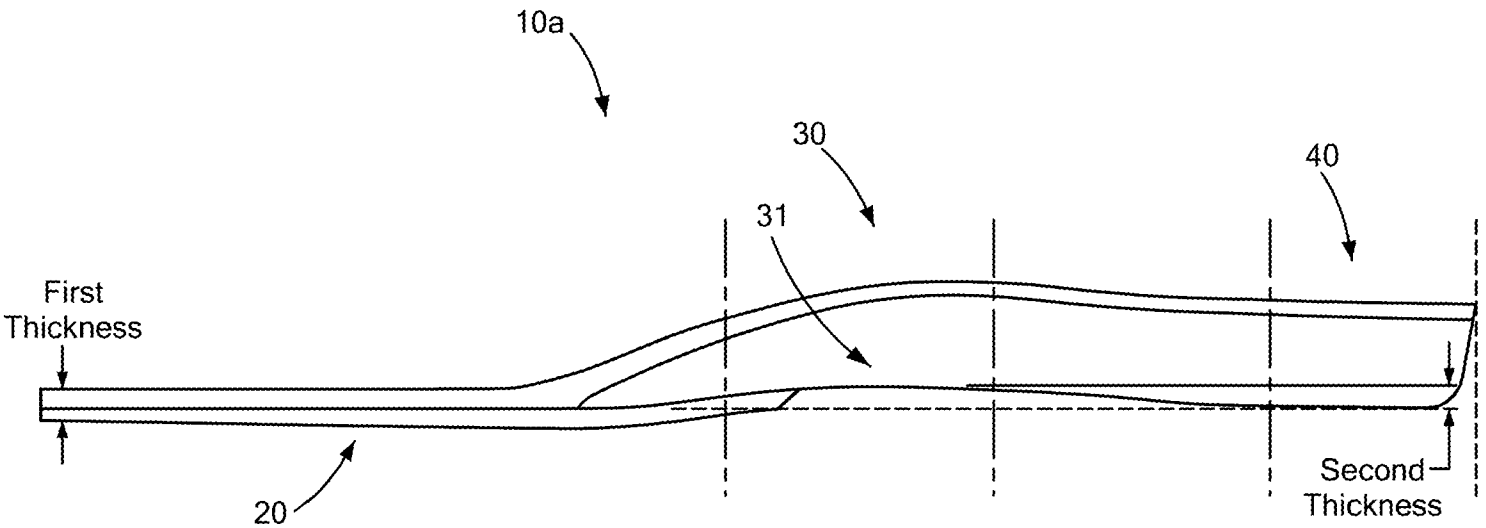
FIG. 6 is a line drawing of an inside (medial) side of an insole for a right shoe for a right handed golfer, mirrored across the y axis, in accordance with this disclosure.

The forefoot portion 20 has a first thickness at its latitudinal midpoint, as perhaps best shown on the insole 10*a* shown in FIG. 6. The hindfoot portion 40 has a second thickness at its latitudinal midpoint, as also illustrated in FIG. 6. The first thickness is greater than the second thickness such that the forefoot of the foot of a golfer wearing a shoe with the insole 10*a* installed is inclined with respect to the heel of the foot of the golfer. It should be appreciated that the insole 10*b* possess the same arrangement of thicknesses.

A golf swing has five phases: address, take-away, backswing, foreswing, and follow-through. Many recreational golfers lean forward on their toes instead of keeping their weight back on their heels, beginning during address phase of the golf swing. Inherently, this forward causes a golfer to stay in a poor postural position during each of the five phases of the golf swing, resulting in a less than ideal swing and poor performance. By elevating the forefoot of the golfer with the inclined forefoot portion 20 of the insoles 10*a*, 10*b* better posture beginning with address, and continuing through takeaway, backswing, foreswing and follow-through is facilitated. Although the elevation differential of the forefoot with respect to the heel provided by the insoles 10*a*, 10*b* can be relatively small in some applications, such as 4 millimeters, the effect has on golfers is marked and noticeable. Posture and balance are two key elements of obtaining a better address of the ball, and the elevated forefoot portion 20 of the insoles 10*a*, 10*b* advantageously helps to facilitate these key elements.

The midfoot portion 30 of both insoles 10*a*, 10*b* may be shaped to define an arch 31 extending between the forefoot portion 20 and the hindfoot portion 40. This arch 31 is shaped so as to snugly fit against the arch of the foot of the golfer. Proprioception is the body's ability to restabilize and balance itself, and therefore is influential during a golf swing. The quicker proprioceptors can react and send information to the brain, the more stable and balanced the golfer will be at each phase of the golf swing. This is not only important upon the address phase of the golf swing, but also during takeaway, backswing and fore swing phases as well. The intimate and snug fit of the arch 31 of the insoles 10*a*, 10*b* provides noticeable feedback to the golfer, thereby increasing the proprioception process of the golfer's body.

Figure 5:
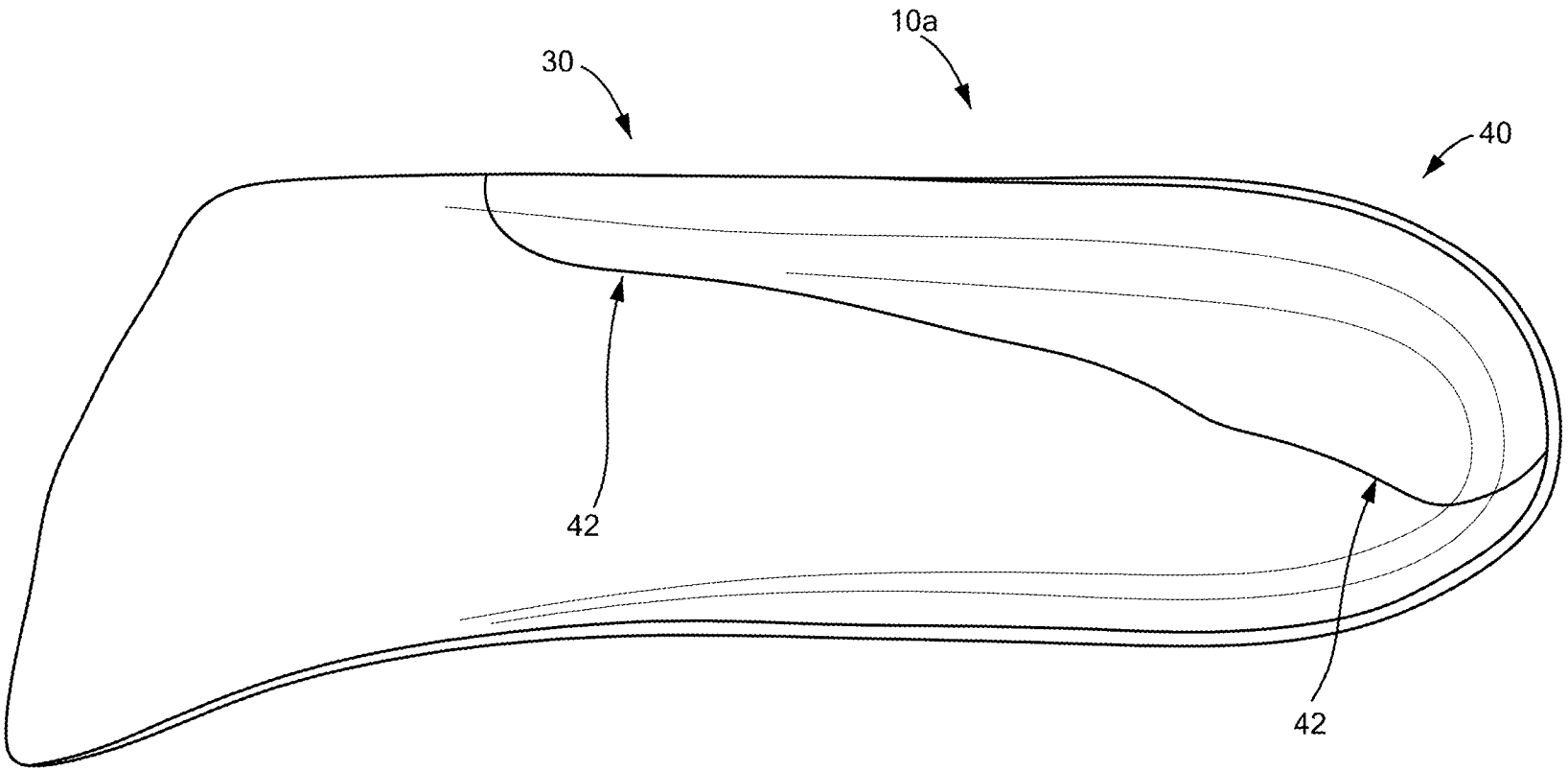
FIG. 5 a top perspective view showing the power plug of the insole for a right shoe of a right handed golfer as disclosed herein.

As shown in FIG. 5, an energy plug 42 is attached to the midfoot portion 30 and hindfoot portion 40 of the insole 10*a*. The energy plug is not present on the insole 10*b*, and is thus only for the insole 10*a* for the right foot.

The energy plug 42 covers outside lateral portions of the midfoot portion 30 and hindfoot portion 40. By outside portions, it is meant the portions that are in line with an outside portion of the foot of a golfer when wearing golf shoes with the insole 10*a*. The dimensions of the energy plug 42 are such that when the insole 10*a* is placed within a golf shoe and when the foot of the golfer is placed within the shoe to contact the insole 10*a*, the energy plug 42 extends from a center of a heel laterally to just distal to the base of the fifth metatarsal of the foot. The energy plug 42 is constructed from a resilient material having a higher rebound rate than that of the resilient material from which the forefoot portion 20, midfoot portion 30, and hindfoot portion 40 are constructed from. This high rebound resilient material may be polyurethane, for example.

The purpose of the energy plug 42 is to compresses upon loading of the rear foot of the golfer during the swing, which is the right foot for right-handed golfers and the left foot for left-handed golfers. This loading occurs during the backswing phase of the golf swing. Subsequent to compression, the energy plug 42 then returns energy to the outside of the foot of the golfer, thereby allowing it to return to a more pronated position and moving the weight of the body of the golfer forward. This helps to optimize weight transfer during the transition from the backswing to the foreswing phase of the golf swing.

Figure 7:
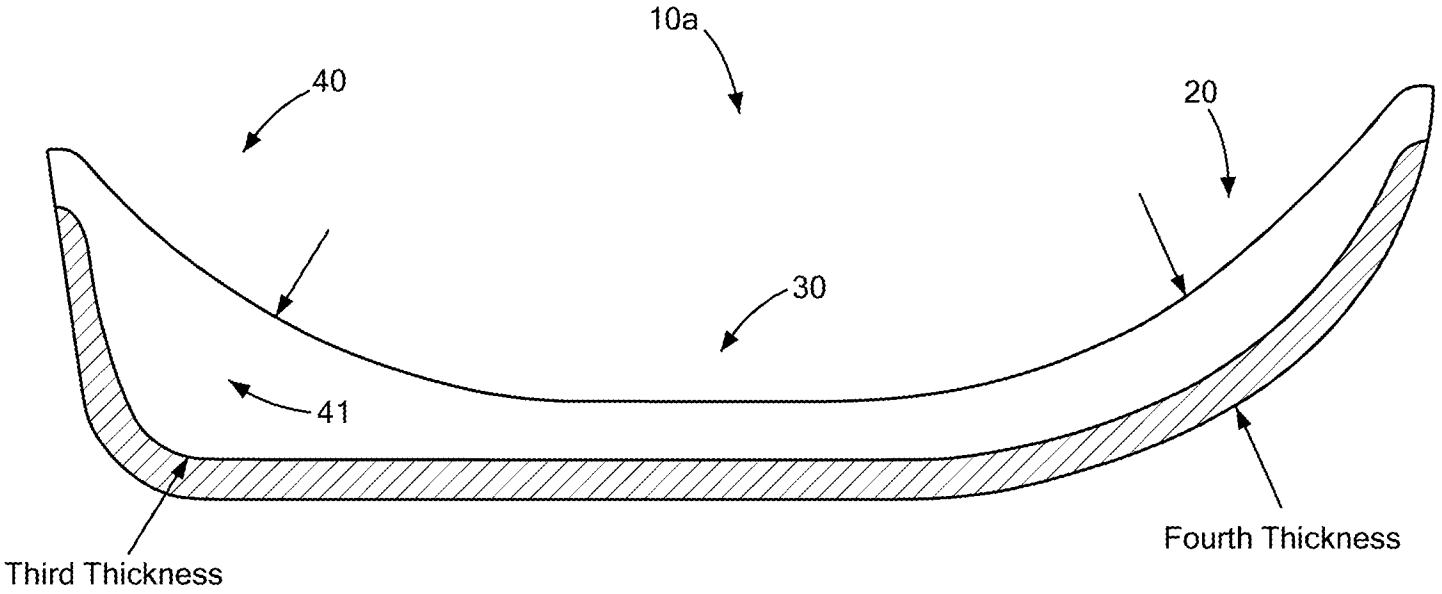
FIG. 7 is another view of an outside (lateral) side of an insole for a right shoe for a right handed golfer in accordance with this disclosure.

The hindfoot portion 40 of insole 10*a* includes a support stabilizer 41 at its outside lateral edge, as best shown in FIGS. 2 and 7. The support stabilizer 41 defines a third thickness of the hindfoot portion 40 at a lateral portion thereof, as best shown in FIG. 7. The third thickness is greater than the first thickness. Thus, due to the support stabilizer 41, the thickness of the hindfoot portion 40 itself increases toward the lateral most edge on which the support stabilizer 41 is located.

As best shown in FIG. 1, the hindfoot portion 40 of insole 10*a* does not include a lateral support stabilizer at its inside medial edge and lacks a medial support stabilizer at the inside medial portion of the hindfoot portion 40 results in a fourth thickness of the hindfoot portion 40 at its inside medial edge being less than the third thickness. As shown in FIG. 3, the hindfoot portion 40 of the insole 10*b* does not include a lateral support stabilizer at its inside medial edge. Thus, the lateral support stabilizer is only present in the insole 10*a* for the right foot.

During the loading phase of the golf swing, the tendency of a golfer is to roll out or supinate on the back foot, which is the right foot for right-handed golfers and the left foot for left-handed golfers. This supinatory motion may be referred to as lateral sway. This swaying motion can cause the golfer to completely lose proper positioning of their swing plane. The support stabilizer 41 braces the lateral edge of the rear foot to reduce lateral sway, thereby helping keep the knee of the golfer positioned toward the midline of the body. This helps to provide for proper positioning and enhanced balance during the backswing, increasing the golfer's chance to stay on a desired plane during the backswing and foreswing phase of the golf swing.

It should be appreciated that insoles for right handed golfers have been shown, but that insoles for left handed golfers are within the scope of this disclosure as well. The difference would be that, for a left handed golfer, the left insole would include the power plug and support stabilizer instead of the right insole. The right foot of a right handed golfer is considered to be the dominant side foot, with the left foot being considered to be the non-dominant side foot. Similarly, the left foot of a left handed golfer is considered to be the dominant side foot, with the right foot being considered to be the non-dominant side foot.

The embodiments and examples set forth herein are presented to best explain the present invention and its practical application and to thereby enable those skilled in the art to make and utilize the invention. However, those skilled in the art will recognize that the foregoing description and examples have been presented for the purpose of illustration and example only. The description as set forth is not intended to be exhaustive or to limit the invention to the precise form disclosed. Many modifications and variations are possible in light of the above teaching without departing from the spirit and scope of the following claims. The invention is specifically intended to be as broad as the claims below and their equivalents.

Definitions

As used herein, the terms "a," "an," "the," and "said" means one or more, unless the context dictates otherwise.

As used herein, the term "about" means the stated value plus or minus a margin of error or plus or minus 10% if no method of measurement is indicated.

As used herein, the term "or" means "and/or" unless explicitly indicated to refer to alternatives only or if the alternatives are mutually exclusive.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the terms "containing," "contains," and "contain" have the same open-ended meaning as "comprising," "comprises," and "comprise," provided above.

As used herein, the terms "having," "has," and "have" have the same open-ended meaning as "comprising," "comprises," and "comprise," provided above.

As used herein, the terms "including," "includes," and "include" have the same open-ended meaning as "comprising," "comprises," and "comprise," provided above.

As used herein, the phrase "consisting of" is a closed transition term used to transition from a subject recited before the term to one or more material elements recited after the term, where the material element or elements listed after the transition term are the only material elements that make up the subject.

As used herein, the term "simultaneously" means occurring at the same time or about the same time, including concurrently.

INCORPORATION BY REFERENCE

All patents and patent applications, articles, reports, and other documents cited herein are fully incorporated by reference to the extent they are not inconsistent with this invention.

The invention claimed is:

1. A pair of insoles dimensioned to fit within a pair of shoes, the pair of insoles comprising:

a dominant side insole comprising:

a forefoot portion having a first thickness at a latitudinal midpoint thereof;

a midfoot portion attached to the forefoot portion;

a hindfoot portion attached to the midfoot portion;

wherein the hindfoot portion has a second thickness at a latitudinal midpoint thereof, the second thickness being less than the first thickness such that when the dominant side insole is placed within the shoe and when a foot is placed within the shoe to contact the dominant side insole, the second thickness and the first thickness are configured such that a forefront of the foot is inclined with respect to the hindfoot portion of the foot;

wherein the hindfoot portion includes a support stabilizer at an outside lateral portion thereof; and an energy plug attached to the midfoot portion and hindfoot portion and covering lateral portions thereof, the energy plug being constructed from a resilient material; and a non-dominant side insole comprising:

a forefoot portion having a first thickness at a latitudinal midpoint thereof;

a midfoot portion attached to the forefoot portion;

a hindfoot portion attached to the midfoot portion; and wherein the hindfoot portion has a second thickness at a latitudinal midpoint thereof, the second thickness being less than the first thickness such that when the non-dominant side insole is placed within the shoe and when a foot is placed within the shoe to contact the non-dominant side insole, the second thickness and the first thickness are configured such that a forefront of the foot is inclined with respect to the hindfoot portion of the foot.

2. The pair of insoles of claim 1, wherein the support stabilizer defines a third thickness of the hindfoot portion at a lateral portion thereof, the third thickness being greater than the first thickness.

3. The pair of insoles of claim 1, wherein the support stabilizer defines a non-uniform thickness of the hindfoot portion that increases toward a lateral most edge of the hindfoot portion.

4. The pair of insoles of claim 1, wherein the midfoot portion of each of the dominant side insole and non-dominant side insole is shaped to define an arch extending between the forefoot portion and the hindfoot portion.

5. The pair of insoles of claim 1, wherein the forefoot portion, midfoot portion, and hindfoot portion of each of the dominant side insole and non-dominant side insole are constructed from resilient material; and wherein the resilient material of the energy plug on the dominant side insole has a higher rebound rate than that of the resilient material of the forefoot portion, midfoot portion, and hindfoot portion.

6. The pair of insoles of claim 1, wherein the hindfoot portion of the non-dominant side insole does not include a medial support stabilizer at an inside medial portion thereof.

7. The pair of insoles of claim 6, wherein the support stabilizer defines a third thickness of the hindfoot portion of the dominant side insole at an outside lateral portion thereof, the third thickness being greater than the first thickness; and wherein lack of a medial support stabilizer at the inside medial portion of the hindfoot portion of the non-dominant side insole results in a fourth thickness of the hindfoot portion at the inside medial portion thereof being less than the third thickness.

8. The pair of insoles of claim 1, wherein the energy plug is configured such that when each of the dominant side insole and non-dominant side insole is placed within the shoe and when a foot is placed within the shoe to contact the dominant side or non-dominant side insole, the energy plug is configured such that it extends from a center of a heel laterally to just distal to a base of a fifth metatarsal of the foot.

9. The pair of insoles of claim 1, wherein the non-dominant side insole does not have the energy plug and does not have a lateral support stabilizer.

10. A pair of insoles dimensioned to fit within a pair of shoes, the pair of insoles comprising:

a dominant side insole comprising:

a forefoot portion having a first thickness at a latitudinal midpoint thereof;

a midfoot portion attached to the forefoot portion;

a hindfoot portion attached to the midfoot portion;

wherein the hindfoot portion has a second thickness at a latitudinal midpoint thereof, the second thickness of the hindfoot portion being less than the first thickness of the forefoot portion;

wherein the hindfoot portion includes a support stabilizer at an outside lateral portion thereof; and an energy plug attached to the midfoot portion and hindfoot portion and covering a lateral portion of the dominant side insole, the energy plug being constructed from a resilient material; and a non-dominant side insole comprising:

a forefoot portion having a first thickness at a latitudinal midpoint thereof;

a midfoot portion attached to the forefoot portion;

a hindfoot portion attached to the midfoot portion; and wherein the hindfoot portion has a second thickness at a latitudinal midpoint thereof, the second thickness being less than the first thickness; and wherein the energy plug is configured such that when each of the dominant side insole and non-dominant side insole is placed within the shoe and when a foot is placed within the shoe to contact the dominant side or non-dominant side insole, the energy plug is configured such that it extends completely along the lateral portion of the insole from a center of a heel to just distal to a base of a fifth metatarsal of the foot.

11. The pair of insoles of claim 10, wherein the first thickness of the forefront portion on the dominant side insole is such that when it is placed within the shoe and when a foot is placed within the shoe to contact the insole, the second thickness of the hindfoot portion and the first thickness of the forefront portion on the dominant side insole are configured such that the forefront portion of the foot is inclined with respect to the hindfoot portion of the foot; and wherein the first thickness of the forefront portion on the non-dominant side insole is such that when it is placed within the shoe and when a foot is placed within the shoe to contact the insole, the second thickness of the hindfoot portion and the first thickness of the forefront portion on the non-dominant side are configured such that the forefront portion of the foot is inclined with respect to the hindfoot portion of the foot.

12. The pair of insoles of claim 10, wherein the forefoot portion, midfoot portion, and hindfoot portion of each of the dominant side insole and non-dominant side insole are constructed from resilient material; and wherein the resilient material of the energy plug on the dominant side insole has a higher rebound rate than that of the resilient material of the forefoot portion, midfoot portion, and hindfoot portion.

13. The pair of insoles of claim 12 wherein the energy plug is composed of a material different than that of the forefoot portion, the midfoot portion or the hindfoot portion of the dominant insole.

14. A pair of insoles dimensioned to fit within a pair of shoes, the pair of insoles comprising:

a dominant side insole comprising:

a forefoot portion having a first thickness at a latitudinal midpoint thereof;

a midfoot portion attached to the forefoot portion;

a hindfoot portion attached to the midfoot portion;

wherein the hindfoot portion has a second thickness at a latitudinal midpoint thereof, the second thickness of the hindfoot portion being less than the first thickness of the forefoot portion;

wherein the hindfoot portion includes a support stabilizer at an outside lateral portion thereof; and an energy plug attached to the midfoot portion and hindfoot portion and covering a lateral portion of the dominant side insole, the energy plug being constructed from a resilient material; and a non-dominant side insole comprising:

a forefoot portion having a first thickness at a latitudinal midpoint thereof;

a midfoot portion attached to the forefoot portion;

a hindfoot portion attached to the midfoot portion; and wherein the hindfoot portion has a second thickness at a latitudinal midpoint thereof, the second thickness being less than the first thickness; and wherein the non-dominate side insole does not have the energy plug.

15. The pair of insoles of claim 14 wherein the hindfoot portion of the dominant side insole does not include the support stabilizer at an inside medial portion thereof and thereby defining a fourth thickness.

16. The pair of insoles of claim 15 wherein the support stabilizer on the dominant side insole defines a third thickness of the hindfoot portion at a lateral portion thereof, the third thickness being greater than the first thickness.

17. The pair of insoles of claim 16 wherein the fourth thickness of hindfoot portion of the dominant side insole is less than the third thickness of the hindfoot portion of the dominant side insole.

* * * * *